US005657919A

United States Patent [19]

Berry et al.

[11] Patent Number: 5,657,919

[45] Date of Patent: Aug. 19, 1997

[54] MODULAR FASTENER DRIVING TOOL WITH NOISE REDUCING STRUCTURE

[75] Inventors: Brian E. Berry, Indianapolis, Ind.; Leo V. Peterson, Bloomfield, Mich.

[73] Assignee: Masterset Inc., Indianapolis, Ind.

[21] Appl. No.: 753,802

[22] Filed: Sep. 3, 1991

[51] Int. Cl.[6] ..... B25C 1/14

[52] U.S. Cl. ..... 227/10; 227/9; 173/DIG. 2

[58] Field of Search ..... 227/9, 10, 11; 60/632, 635, 637; 173/DIG. 2

[56] References Cited

U.S. PATENT DOCUMENTS

| | | | |
|---|---|---|---|
| 3,481,143 | 12/1969 | Shing Hsu | 227/10 X |
| 3,589,584 | 6/1971 | Ohlsson et al. | 227/10 |
| 4,068,790 | 1/1978 | Osterle et al. | 227/10 X |
| 4,196,834 | 4/1980 | Beton | 227/10 |
| 4,218,005 | 8/1980 | Harris | 227/10 |
| 4,493,376 | 1/1985 | Kopf | 227/9 X |
| 4,577,793 | 3/1986 | Jochum | 227/10 |
| 4,711,385 | 12/1987 | Jochum | 227/10 |
| 4,830,254 | 5/1989 | Hsu | 227/10 |
| 4,877,171 | 10/1989 | Almeras | 227/10 |
| 4,898,315 | 2/1990 | Vernerey | 227/10 |

FOREIGN PATENT DOCUMENTS

| | | | |
|---|---|---|---|
| 3605832 | 8/1987 | Germany | 227/10 |

*Primary Examiner*—Rinaldi I. Rada
*Assistant Examiner*—Clark F. Dexter
*Attorney, Agent, or Firm*—William W. Jones

[57] ABSTRACT

The powder actuated tool has a modular construction which comprises: a firing pin module; a pistol grip module; and a fastener driving module. The firing pin module and the fastener driving module are readily detachable from the pistol grip module so that if any module is damaged, or needs maintenance, it may be readily removed and replaced at low cost and at no inconvenience to the user. The fastener driving module includes a barrel which is reciprocally slidably mounted in the pistol grip module. A fastener driving piston is carded in the barrel and a piston return pawl is mounted on the pistol grip module for returning the piston from a fired position to a firing position via a slot in the barrel. Combustion gas ports in the barrel bleed gases from the barrel bore adjacent to the firing chamber. The bled gases pass through external grooves in the barrel to reentry ports communicating with the barrel bore, whereby tool noise is muffled. Piston overdrive can be corrected merely by reciprocating the barrel in the pistol grip housing.

5 Claims, 2 Drawing Sheets

MODULAR FASTENER DRIVING TOOL WITH NOISE REDUCING STRUCTURE

TECHNICAL FIELD

This invention relates to an improved piston-type powder-actuated fastener driving tool. More particularly, this invention relates to a tool of the character described having an improved fastener driving module providing quieter operation and providing piston overdrive correction.

BACKGROUND ART

Powder actuated tools are well known in the construction field for driving fasteners, such as nails, studs, or anchors, into a relatively hard supporting surface, such as concrete. Such tools utilize a piston for driving the fastener. The piston is typically driven by an explosive blank cartridge. Combustion gases generated from the cartridge drive the piston from a breechward positon to a muzzleward position to drive the fastener into the supporting surface.

Use of an explosive charge to fire the tool, obviously, creates noise which is undesirable. Additionally, the explosive charge will occasionally overdrive the fastener driving piston, a condition which occurs when the piston is driven past the piston return pawl and into the buffer. This always occurs when the operator forgets to insert a fastener into the muzzle of the tool, and can also occur occasionally at other times.

DISCLOSURE OF THE INVENTION

According to the invention, a powder actuated tool is provided which has a modular design comprising: a firing pin module; a pistol grip module; and a fastener driving module. The firing pin module and the fastener driving module are readily detachable from the pistol grip module so that if any module is damaged or needs maintenance, it may be readily removed from the remainder of the tool and replaced at the job site at low cost to the user, and without significant interruption of use.

The fastener driving module includes a barrel which has a breechward end with an integral firing chamber formed therein. The muzzleward end of the barrel is threaded to receive a muzzle bushing into which a fastener to be driven is inserted. A fastener driving piston is disposed in a bore in the barrel, which bore communicates with the firing chamber to receive combustion gases from cartridges fired therein. A piston return pawl is mounted in a muzzleward end of the pistol grip module, the pawl extending through an elongated slot in the barrel to engage a breechward head portion of the piston after the latter has been driven muzzlewardly. Reciprocal muzzleward and breechward movement of the barrel in the pistol grip module results in returning the piston from its driven to its driving positions in the barrel bore. The exterior of the barrel is formed with circumferential combustion gas ducting grooves and adjacent gas ducting flats which control flow of combustion gases from breechward radial combustion gas vent holes in the barrel, to muzzleward radial gas reentry ports in the barrel. The gas vent holes are proximal to the firing chamber so as to immediately draw combustion gases from the barrel bore after initial propulsion of the piston has commenced. The gas reentry ports are spaced muzzlewardly along the barrel so as to ensure that combustion gases will reenter the barrel breechwardly of the piston head as the piston moves muzzlewardly to drive the fastener. This ensures that the combustion gases cannot escape from the tool in the joint between the pistol grip module and the fastener driving module, thereby providing a quieter tool. The tool of this invention operates at a 99.7 decibel level with a medium level power load, while the prior art tools of the type disclosed in U.S. Pat. No. 4,493,376 granted Jan. 15, 1985 to R. J. Kopf, which also have an integral firing chamber in a breechward end of a barrel operate at a 108.2 decibel level with the same power load. The difference in noise levels is because there are no gas reentry ports, and no gas flow grooves in the prior art tools, which ensure that combustion gases will reenter the barrel bore before being expelled from the tool between the fastener driving and pistol grip modules.

The tool is also equipped to correct a piston overdrive condition with minimal complexity. As noted above, the fastener driving piston will occasionally overdrive into the muzzle bushing and beyond the piston return pawl. The piston head has a breechward angularly tapered surface which will automatically cam the return pawl out of the way by simple piston returning reciprocation of the barrel in the pistol grip module. The tool of this invention thus does not need to be partially disassembled to correct piston overdrive, as do the prior art tools.

It is therefore an object of the invention to provide a powder actuated tool which is composed of separate and individually replaceable modules.

It is a further object of the invention to provide a tool of the character described which is simple, and inexpensive to repair due to the modular construction thereof.

It is yet another object of the invention to provide a tool which is relatively quiet when fired as compared to similar prior art tools.

It is an additional object of this invention to provide a tool of the character described in which piston overdrive can be readily remedied.

These and other objects and advantages of the invention will become more readily apparent from the following detailed description of a preferred embodiment of a tool formed in accordance with this invention when taken in conjunction with the accompanying drawings in which:

DETAILED DESCRIPTION OF THE BEST MODE

Figure 1:
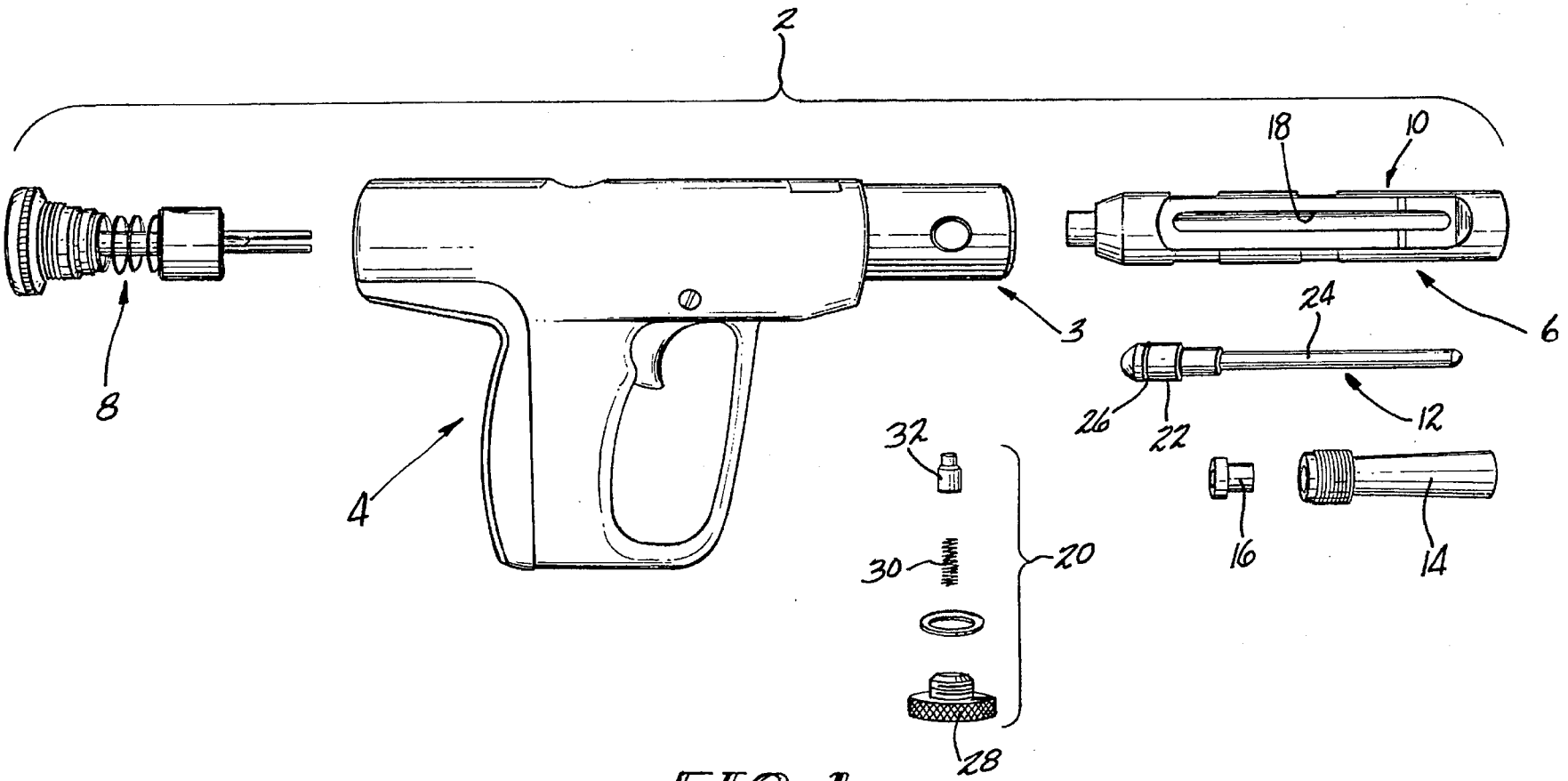
FIG. 1 is an exploded view of an automatic cartridge strip feeding embodiment of the tool of this invention.

Referring now to FIG. 1, a best mode embodiment of the powder actuated tool of the invention is shown. The powder actuated tool 2 comprises a pistol grip module 4, a fastener driving module 6, and a firing pin module 8. The tool 2 is designed to utilize a strip of explosive charges which are automatically fed through the tool after each fastener is driven into a supporting surface. Aside from having automatic cartridge feeding capabilities, the tool of this invention operates in a manner which is very similar to the tool shown in the aforesaid U.S. Pat. No. 4,493,376 granted Jan. 15, 1985, which is incorporated herein in its entirety.

The fastener driving module 6 includes a cylindrical barrel member 10, a piston 12 disposed within the barrel 10, and a muzzle bushing 14 with an internal polyurethane buffer 16, which muzzle bushing 14 is screwed into the muzzleward end of the barrel 10. The barrel 10 is mounted slideably within the muzzleward end 3 of the pistol grip module 4. The barrel 10 has an elongated slot 18 for reception of a piston return assembly 20 allowing the latter to contact the piston 12. The piston 12 has a head portion 22 and a stem portion 24 extending along the bore of the barrel into the muzzle bushing 14. A piston ring 26 is disposed about the head portion 22 to provide a gas tight fit within the barrel 10.

The piston return pawl assembly 20 comprises a pawl housing 28, a spring 30 disposed within a bore in the housing 28, and a pawl 32 which is disposed in the pawl housing bore atop the spring 30. The pawl 32 extends into the barrel 10 through the barrel slot 18 to contact the piston head 22. The piston return assembly 20 operates to return the fired piston to a firing position in the same manner as in the tool disclosed in U.S. Pat. No. 3,066,302 to DeCaro et al, which is incorporated herein in its entirety.

Figure 3:
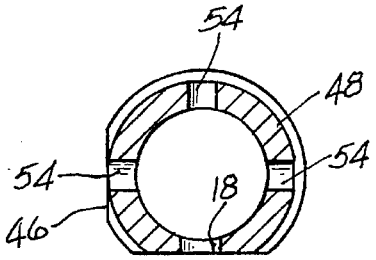
FIG. 3 is a cross-sectional view of the barrel taken along line 3—3 of FIG. 2.
Figure 2:
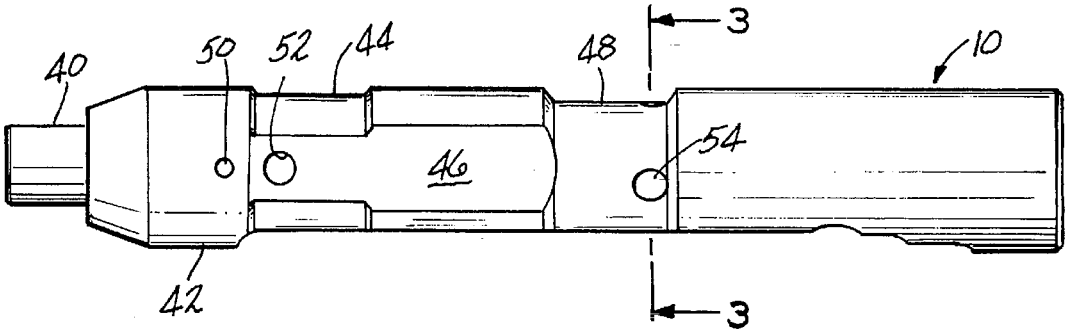
FIG. 2 is a side elevational view of the tool barrel.

Referring to FIGS. 2 and 3, the barrel 10 includes a breechward boss 40 which contains the cartridge firing chamber. A radially enlarged portion 42 is disposed muzzlewardly of the boss 40. A first circumferential gas flow groove 44 is formed in the exterior of the barrel 10. The first groove 44 communicates with a longitudinal flat 46 on the exterior of the barrel 10. The flat 46 communicates with a second circumferential gas flow groove 48 in the exterior of the barrel 10. Breechward gas venting holes 50 and 52 are formed in the barrel 10 extending radially from the barrel bore to the exterior of the barrel 10. The breechwardmost vent hole 50 is formed in the enlarged portion 42 of the barrel 10, and the subsequent vent hole 52 is formed in the flat 46. A plurality of gas reentry ports 54 are formed in the gas flow groove 48. It will be noted that the grooves 44 and 48 communicate with each other through the flat 46 and through the pawl slot 18.

Figure 4:
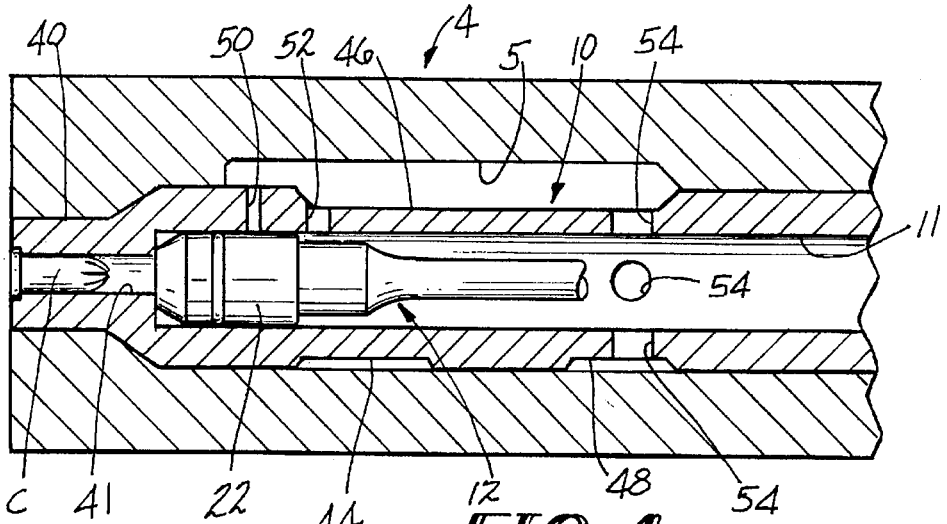
FIG. 4 is a fragmented sectional view of the firing chamber end of the barrel shown in the pistol grip module in the firing position.

Referring to FIG. 4, the barrel 10 is shown in a breechwardmost firing position in the pistol grip module 4. The firing chamber 41 disposed in the barrel boss 40 contains a blank cartridge C, and the piston 12 is in a breechward firing position within the barrel 10. The barrel bore 11 communicates with the firing chamber 41, and also with the vent holes 50 and 52, and with the reentry ports 54. As will be noted, when the piston 12 is in its firing position, the piston head 22 closes the vent hole 50. Cartridge combustion gases will therefore not vent from the barrel bore 11 until the piston head 22 moves muzzlewardly past the breechward vent hole 50. A cavity 5 is formed in the pistol grip module 4 to provide a combustion gas flow connection between the vent hole 50, the flat 46 and the groove 44. Once the piston head 22 moves muzzlewardly beyond the vent hole 50, combustion gases will begin to vent from the barrel bore 11 through the vent hole 50 into the cavity 5. Subsequent movement of the piston head 22 past the vent hole 52 will increase venting of combustion gases from the barrel bore 11 into the cavity 5.

The vented combustion gases then travel across the flat 46 and through the grooves 44 and 48 to the reentry ports 54. The gas flow path area (or volume) available to duct combustion gases from the barrel bore 11, and then back into the barrel bore 11 is calculated so as to ensure that the piston head 22 will have moved muzzlewardly past the reentry ports 54 (and the muzzleward end of the pawl slot 18) before the vented combustion gases can reenter the barrel bore 11. Combustion gases thus do not escape from the tool at the muzzleward end 3 of the pistol grip module 4, as they do with the prior art tools.

Figure 5:
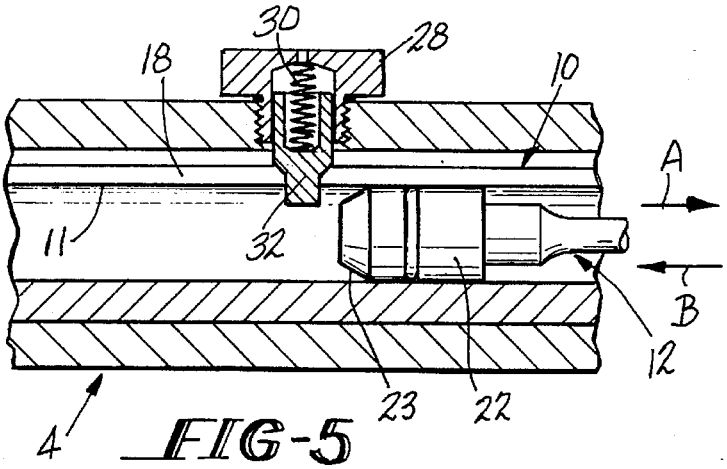
FIG. 5 is a fragmented sectional view of the barrel and pistol grip module showing the piston overdriven muzzlewardly beyond the piston return pawl.

Referring now to FIG. 5, the piston 12 is shown in an overdrive position wherein the piston head 22 has been driven muzzlewardly beyond the piston return pawl 32. To correct this condition, the barrel 10 need merely be pulled muzzlewardly, in the direction of the arrow A, so as to place the piston 12 at its breechward firing position in the barrel bore 11. Return breechward movement of the barrel 10 in the direction of the arrow B will drag the piston 12 breechwardly past the pawl 32 by reason of frictional engagement between the piston head 22, the piston ring, and barrel bore 11, and also by reason of the angled breechward surface 23 on the piston head 22 contacting the pawl 32. When the piston head surface 23 contacts the pawl 32 as the barrel 10 is returned breechwardly, the pawl 32 is pushed radially outwardly against the bias of the spring 30 by the piston head surface 23 so that the piston 12 can pass breechwardly past the pawl 32. Thus piston overdrive can be easily and quickly remedied by a simple reciprocation of the barrel 10 in the pistol grip module 4.

It will be readily appreciated that the tool of this invention will provide quieter operation and can remedy piston overdrive occurrences with minimal effort. One need merely perform the conventional piston return manuever to free up the piston and return it past the return pawl to its firing position.

Since many changes and variations of the disclosed embodiment of the invention may be made without departing from the inventive concept, it is not intended to limit the invention otherwise than is required by the appended claims.

What is claimed is:

1. A quieter powder actuated fastener driving tool comprising:

a) a pistol grip module;

b) a barrel reciprocally slidably mounted in said pistol grip module, said barrel comprising an integral breechward firing chamber communicating with a bore in said barrel;

c) a fastener driving piston reciprocally slidably mounted in said barrel bore, said piston having an enlarged breechward head for providing a gas tight fit with said barrel bore, and said piston being movable in said barrel bore between a breechward driving position and a muzzleward driven position;

d) a first breechward combustion gas vent hole extending from said barrel bore to an exterior surface of said barrel;

e) a gas reentry port extending from the exterior surface of the barrel to said barrel bore muzzleward of said gas vent hole; and f) gas flow means between said barrel and said pistol grip module for ducting combustion gases from said vent hole to said reentry port when a cartridge is fired in the firing chamber to drive the piston through its fastener driving stroke, said gas flow means being sized to ensure that vented combustion gases reach said reentry port only after said piston head has been driven muzzlewardly past said reentry port, thereby returning vented gases to the barrel bore breechwardly of the piston to reduce the noise level of the tool.

2. The tool of claim 1 wherein said gas flow means comprises: first and second circumferential gas ducting grooves formed in the exterior surface of said barrel, said grooves being spaced longitudinally along said barrel; a longitudinal flat formed on the barrel exterior surface, said flat connecting said grooves; and said reentry port being disposed in a muzzleward one of said grooves.

3. The tool of claim 2 wherein there are a plurality of reentry ports disposed in said muzzleward one of said grooves.

4. The tool of claim 2 further comprising a cavity formed in said pistol grip module for providing a combustion gas flow path between said gas vent hole, said flat, and a breechward one of said grooves.

5. The tool of claim 4 further comprising a second gas vent hole disposed in a breechward end of said flat for venting combustion gases directly from said barrel bore to said flat.

* * * * *